United States Patent [19]

Kuhnau

[11] 4,188,878

[45] Feb. 19, 1980

[54] RESTRAINING DEVICE FOR USE IN DRYING LUMBER

[75] Inventor: Bruce L. Kuhnau, Auburn, Wash.

[73] Assignee: Weyerhaeuser Company, Tacoma, Wash.

[21] Appl. No.: 957,603

[22] Filed: Nov. 3, 1978

[51] Int. Cl.[2] ..... B30B 1/30

[52] U.S. Cl. ..... 100/212; 24/255 R; 24/269; 34/143; 34/239; 248/499; 269/131; 269/254 R

[58] Field of Search ..... 34/9.5, 13.4, 13.8, 34/38, 239, 143–145; 206/321, 323; 280/179 R, 179 A; 269/130, 131, 132, 254 R; 24/255, 269; 248/499; 100/3, 212; 267/158

[56] References Cited

U.S. PATENT DOCUMENTS

| | | | |
|---|---|---|---|
| 620,114 | 2/1899 | Ferrell | 280/179 A |
| 620,869 | 3/1899 | Horton | 100/212 X |
| 772,157 | 10/1904 | Koehler | 280/179 A |
| 1,212,583 | 1/1917 | Tanner | 34/13.8 |
| 1,506,649 | 8/1924 | Lotte | 248/499 X |
| 1,693,395 | 11/1928 | Lawton | 34/38 X |
| 1,972,346 | 9/1934 | Juline | 280/179 A |
| 2,448,288 | 8/1948 | Alk | 100/212 X |
| 3,155,030 | 11/1964 | Curtis | 100/265 X |
| 3,412,475 | 11/1968 | Zec | 34/239 X |

FOREIGN PATENT DOCUMENTS

| | | | |
|---|---|---|---|
| 240092 | 3/1946 | Switzerland | 280/179 A |

*Primary Examiner*—William F. O'Dea
*Assistant Examiner*—Harold Joyce

[57] ABSTRACT

A restraining device is used in a dry kiln with a load of green lumber in order to reduce warpage during drying and cooling. A single restraint device is comprised of a pair of inverted leaf springs joined together at their centers and having a strap extending from one end of the top spring about the load of lumber and terminating at the other end of the top spring together with a tensioning device for the strap. Before the load of lumber is placed in the dry kiln, the tensioning device will draw down both the bottom and top leaf springs close to the load where the tensioning device will lock them in place. During drying, as the load shrinks, the top spring will be relaxed while the bottom spring will maintain a force across the width of the load, thereby substantially reducing warp.

7 Claims, 4 Drawing Figures

Fig. 1
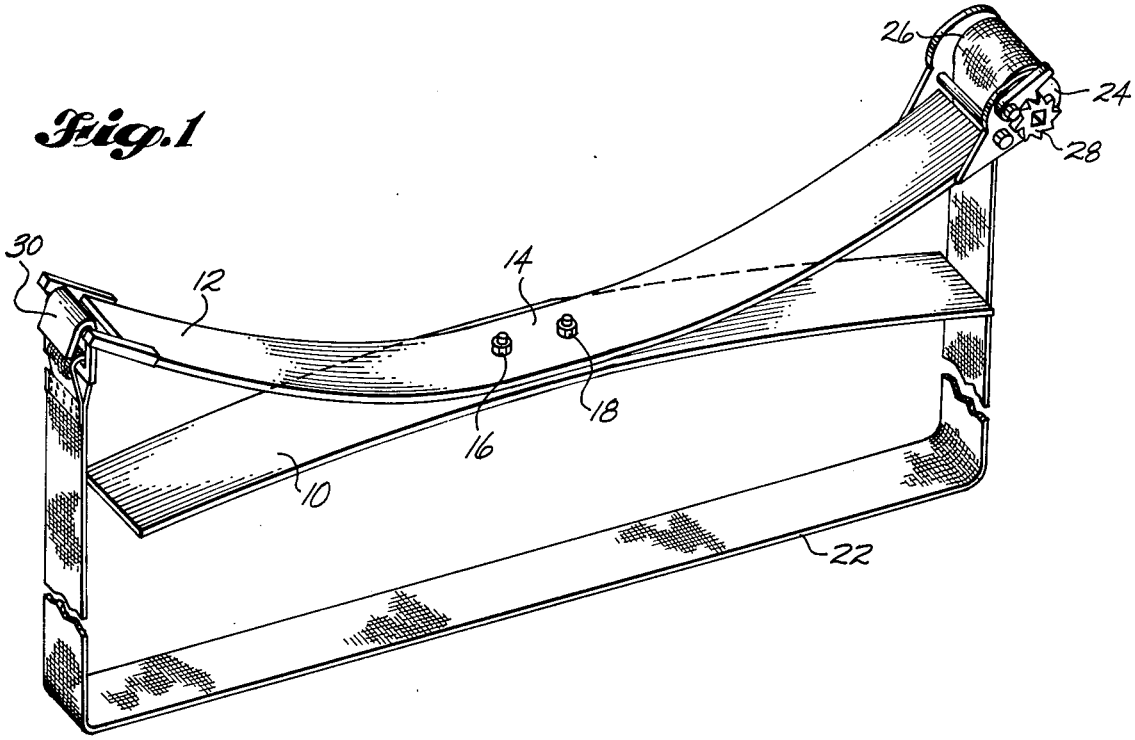
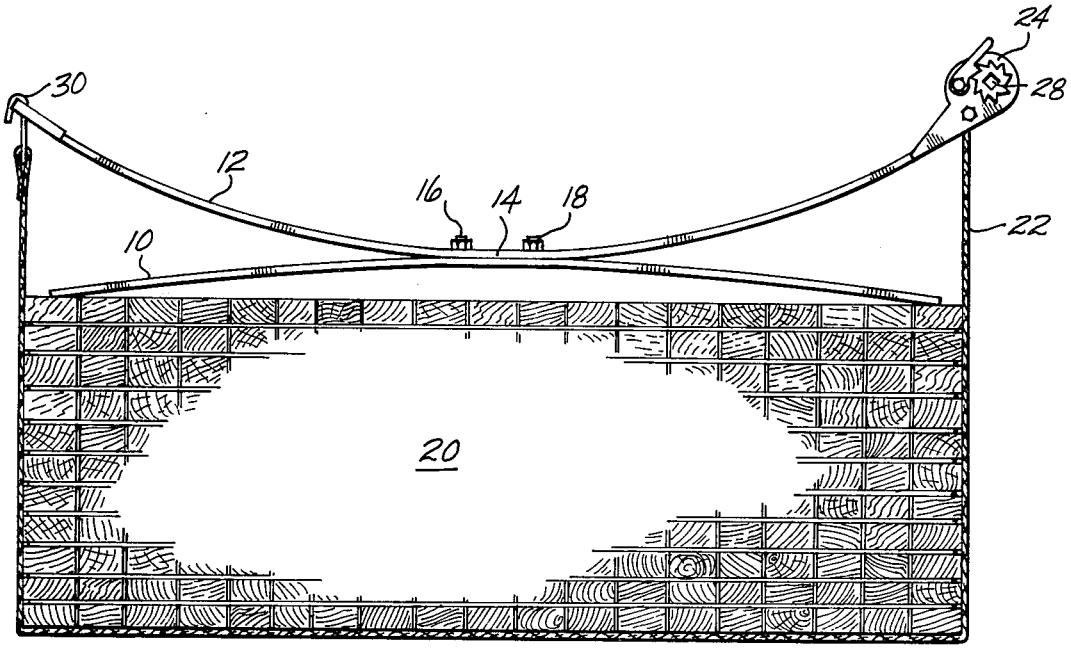
Fig. 2

RESTRAINING DEVICE FOR USE IN DRYING LUMBER

BACKGROUND OF THE INVENTION

This invention relates generally to a device for reducing warpage of lumber during drying and cooling and, more particularly, to a leaf spring device that counteracts the drying stain during actual drying and cooling, thereby resulting in straighter dried lumber.

Lumber such as 2×4s, 2×6s, 2×8s, 2×10s and 2×12s are usually placed in a dry kiln after manufacture and taken down to a moisture content of about 15%. By reducing the moisture content of the lumber, it can then be used in many end-use applications without undergoing future deformation. Typically, lumber to be dried is uniformly stacked in a generally rectangular volume and is referred to as a load or charge. Lumber of a uniform thickness will be selected and stacked in horizontal rows between which are placed "stickers" that separate the rows. Oftentimes these loads of lumber to be dried will be stacked on bunks which are mounted on cars that can be rolled into a dry kiln. The upper layers in a load, unless there is some downward force exerted on the load, will be free to naturally bend upwardly during drying. The lower rows of lumber will, of course, have the weight of the upper rows atop them, thereby having a natural restraining force on them.

It has been recognized in the past that during drying when top rows of green lumber are free to deform they will in fact warp considerably. Such warpage, of course, reduces the market value and various means have been proposed to restrain such warpage. One device may be seen by referring to U.S. Pat. No. 1,212,583—Tanner wherein a restraining device is disclosed that utilizes a pair of beams placed across the load and held together by a spring device that continually exerts a restraining force on the entire load of lumber. It is also known that a static load can be placed on the load such as concrete blocks to restrain warping.

With today's dry kilns, restraining devices are useful but they must be designed so as to fit within the confines of the kiln and in view of the kiln baffling system. The restraining device should not impair the functioning of the baffling system. The device must also be reasonably inexpensive and must serve to exert the continuing restraining force as the load shrinks in size.

Accordingly, from the foregoing, one object of the present invention is to minimize the warpage of lumber during drying and cooling. Another object of this invention is to provide such a device that is relatively inexpensive and easy to manufacture. Yet a further object of this invention is to provide a restraining device that is readily usable with today's dry kilns with their internal baffling systems. These and other objects of the present invention will be more fully understood by reading the following specification in conjunction with the attached drawings.

BRIEF SUMMARY OF THE INVENTION

Briefly stated, the present invention is practiced in one form by a double leaf spring and strap arrangement where a bottom leaf spring has a length that is approximately equal to the width of the load of lumber. A top leaf spring is inverted and has a length that is slightly longer than the bottom spring together with a spring constant that is approximately one half the spring constant of the bottom spring and an arch that is approximately three times greater than the arch of the bottom spring. The width of the top spring can be slightly less than the width of the bottom spring. The strap extends from the ends of the top leaf spring about a load of lumber and a tensioning device is located along the length of the strap preferably at one end thereof. The tensioning device is utilized for bringing the leaf springs together prior to drying and cooling. At least a pair of such double leaf spring and strap arrangements would be utilized for a load of lumber going into a dry kiln. As the load shrinks, the top spring will be relaxed while the bottom spring will maintain a restraining force across the width of the load, thereby minimizing warpage.

BRIEF DESCRIPTION OF THE DRAWINGS

FIG. 1 is a perspective view showing the double leaf spring and strap arrangement and depicts the relative dimensions of the elements.

FIG. 2 is an end view of a load of lumber having the present invention appropriately positioned with respect thereto prior to the strap being tensioned.

DESCRIPTION OF THE PREFERRED EMBODIMENT AND BEST MODE OF MAKING AND USING

Figure 3:
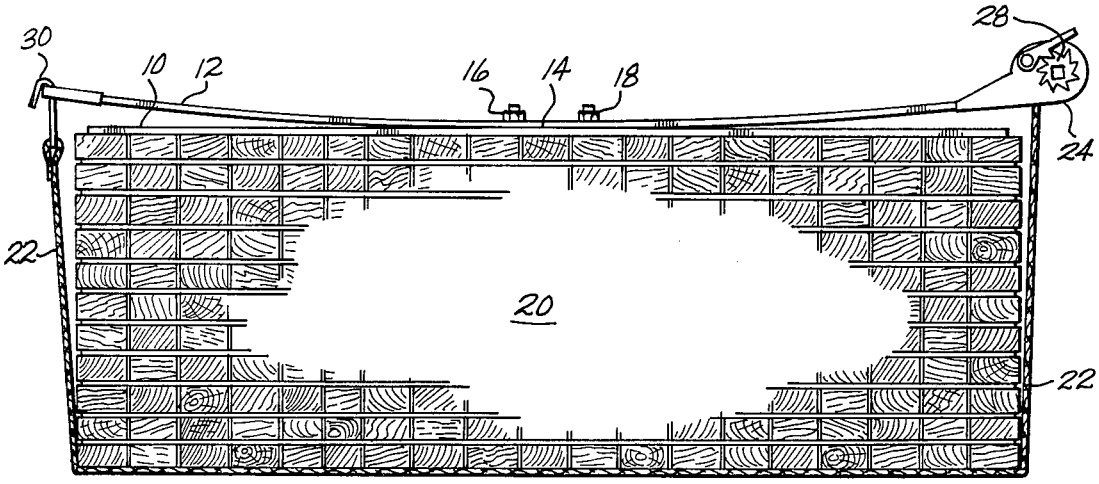
FIG. 3 is a view similar to FIG. 2 showing the strap in the tensioned state.
Figure 4:
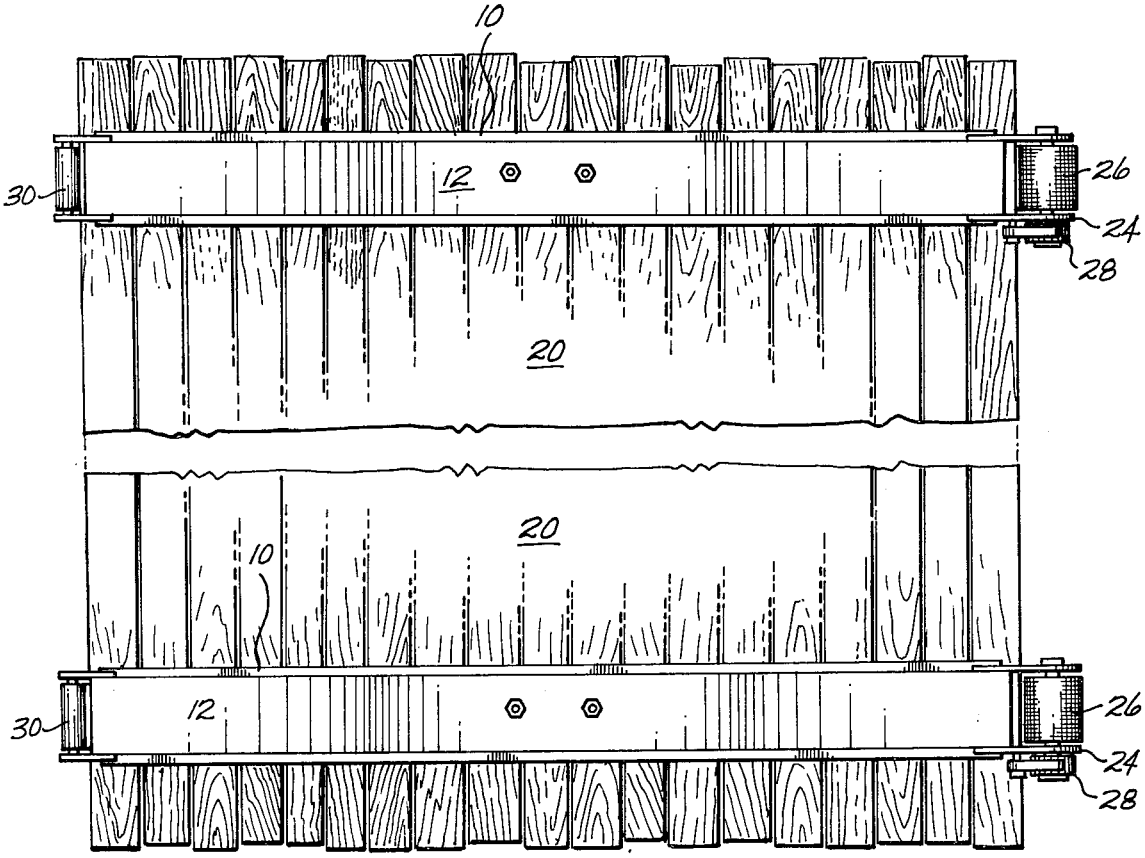
FIG. 4 is a top plan view showing a load of lumber with a pair of the double leaf spring and strap arrangements positioned about the load.

Referring first to FIG. 1, the double leaf spring and strap arrangement for restraining lumber during drying and cooling will be described. One leaf spring indicated at 10 serves as the bottom leaf spring relative to leaf spring 12 which serves as the top leaf spring. The pair of leaf springs 10, 12 are inverted relative to each other such that their convex sides face outwardly. The two springs 10, 12 are joined together at their central portions, collectively indicated at 14, by a pair of fastening means 16, 18. Preferably the fastening means are flush with the bottom surface of bottom spring 10 since that surface will ultimately contact the top row of lumber within a load 20.

In the untensioned state the bottom leaf spring 10 will have a projected horizontal length that is less than the width of a load of lumber to be dried. It will have a width that will be sufficient to maintain it in a stable condition during application about the load 20. As an example not intended to limit the scope of the present invention in any way, the length of bottom spring 10 might be on the order of 48 inches having a width of about 5 inches. These dimensions would apply for a typically sized load of lumber to be dried. The top spring 12 will have a length that is slightly longer than bottom spring 10 and a width that is slightly less. Again, as an example only, the top spring might be on the order of 49 inches in length and have a width of 4 inches. To provide the proper functioning for the double leaf spring and strap arrangement, the bottom spring 10 will have a spring constant approximately twice that of top spring 12 and an arch approximately one third that of the arch of top spring 12. Again, as an example and not intended to limit the present invention in any way, the bottom spring 10 would have an arch of approximately 2 inches and a spring constant of approximately 500 pounds per inch while the top spring 12 would have an arch of approximately 7 inches and a spring constant of approximately 300 pounds per inch. Again, these dimensions are selected to provide the proper functions consistent with the structure of the internal kiln design.

Extending from one end of top spring 12 to the other end is the restraining strap 22. Preferably on one end of spring 12 is a tensioning device 24 for strap 22 whereby the two springs 10, 12 can be flattened in order to exert tension on strap 22. Tensioning device 24 may be comprised of any suitable means such as a roll 26 and rachet device 28. The rachet device 28 allows an operator to conveniently crank roll 26, thereby increasing the tension on strap 22. At the other end of spring 12 strap 22 is fixed thereto by a simple hook arrangement 30. The length of strap 22 is sufficient so that the hooked end of strap 22 can be led around the circumference of a load of lumber and then easily attached to top spring 12 through hook arrangement 30. The material for strap 22 may be any suitable high strength flexible material such as belted polyester or flat steel strapping.

Turning now to FIG. 2, the method of using the present invention will be fully described. A typical single load of lumber 20 consists of a plurality of horizontal rows of lumber such as 2×4s neatly stacked one atop the other. The load 20 will normally be elevated from the floor of a dry kiln and placed atop a kiln car or another load of lumber prior to insertion into the kiln. In the embodiment depicted, the pair of leaf springs 10, 12 are positioned atop the uppermost row of lumber so as to extend across the load. Strap 22 will be loose. An operator will then carry the strap about the load of lumber so as to encircle it and then attach it at hook arrangement 30 to complete the strapping process. After the loose end of strap 22 is hooked at 30, it should be noted that both springs 10, 12 are still in their relaxed state. The operator will then begin tensioning the strap and consequently drawing down springs 10, 12 to a position where bottom spring 10 is substantially horizontal and flat atop the top row of lumber. The top spring 12 will also be substantially flat although in FIG. 3 it is depicted as having a slight curve.

For any given load of lumber at least two of the leaf spring and strap devices will be used, one positioned at one end of the load with the other being positioned at the opposite end. The arrangement then after the two straps are tensioned about the load 20 will provide the restraining force when the drying stresses and cooling stresses are generated. Each strap will be tensioned so that the bottom spring 10 will be in contact with the entire width of the load and so that the top spring 12 will also be substantially flat. In this configuration a downwardly directed compressive force is exerted atop the top surfaces of the lumber in the top row. As shrinkage occurs during drying, the top spring 12 will gradually bend outwardly at its ends while the bottom spring will continue to maintain the restraining force across the width of the load. The arch in the bottom spring will also distribute a force across the load even if a slight convex arch in the load occurs due to shrinkage. During shrinkage, as noted, the bottom spring remains on the load and, when the kiln baffles are positioned substantially at the center of and perpendicular to the restraining device, they will remain effective.

After the load of lumber has been in the dry kiln for the allotted time, it will be removed and, with the restraining devices still in place, allowed to cool. After the load of lumber is cooled, the restraining devices will be removed by releasing rachet device 28 and unhooking each strap 22 from its respective end of top leaf spring 12. Each device is then completely removed from the load of lumber and readied for use with the next load to be inserted into a dry kiln.

While a detailed description of the preferred embodiment and its best mode of making and using has been described, many modifications will occur to those skilled in the art. All such modifications are intended to be included within the scope of the appended claims.

What is claimed is:

1. A restraining device for maintaining a substantially uniform compressive force over a load, comprising:

a first pair of inverted leaf springs joined together approximately at their centers, with the bottom spring adapted to extend across a portion of the width of the load and with the top spring adapted to extend over a portion of the length of the bottom spring, and first means extending from one end of the top leaf spring about the load to the other end for drawing down the leaf springs whereby the compressive force over the load is established.

2. A restraining device as in claim 1 further including a locking device associated with the draw down means for maintaining the leaf springs in a drawn down condition.

3. A restraining device as in claim 1 in which the draw down means includes a flexible strap having a hook on one end thereof.

4. A restraining device as in claim 2 in which the locking device includes a rachet.

5. A restraining device as in claim 1 in which the bottom spring has a spring constant approximately twice that of the top spring.

6. A restraining device as in claim 1 in which the arch of the bottom spring is approximately one third that of the top spring.

7. A restraining device as in claim 1 further including a second pair of inverted leaf springs spaced from said first pair and having second draw down means associated therewith for establishing a second compressive force about the load.

* * * * *